US012617581B2

(12) United States Patent
Jurcak et al.

(10) Patent No.: US 12,617,581 B2
(45) Date of Patent: May 5, 2026

(54) SYSTEM USING CLIPS FOR JOINING CONTAINER SLEEVES

(71) Applicant: Shuert Technology, LLC, Sterling Heights, MI (US)

(72) Inventors: Jeffrey C. Jurcak, Shelby Township, MI (US); Kevin T. Smith, Shelby Township, MI (US); Nenad Ilijeski, Macomb, MI (US)

(73) Assignee: Shuert Technology, LLC, Sterling Heights, MI (US)

( * ) Notice: Subject to any disclaimer, the term of this patent is extended or adjusted under 35 U.S.C. 154(b) by 0 days.

(21) Appl. No.: 18/737,165

(22) Filed: Jun. 7, 2024

(65) Prior Publication Data

US 2025/0376295 A1 Dec. 11, 2025

(51) Int. Cl.
*B65D 19/06* (2006.01)

(52) U.S. Cl.
CPC .... *B65D 19/06* (2013.01); *B65D 2519/00611* (2013.01)

(58) Field of Classification Search
CPC ..... B65D 19/06; B65D 2519/00611
USPC ..... 206/600, 387; 220/4.11, 4.26, 4.29
See application file for complete search history.

(56) References Cited

U.S. PATENT DOCUMENTS 2,972,407 A * 2/1961 Taylor ..... B65D 83/76 426/115
3,072,314 A * 1/1963 Keene ..... B65B 5/108 229/199
3,664,570 A * 5/1972 Kupersmit ..... B65D 19/004 229/122.22
4,019,635 A * 4/1977 Boots ..... B65D 77/0466 217/43 A
5,525,030 A * 6/1996 Buchman ..... B65G 57/005 414/789.5
5,680,948 A * 10/1997 Schmidt ..... B65D 19/16 206/508
5,722,328 A * 3/1998 Darby ..... B65D 19/06 206/600
RE35,875 E 8/1998 Shuert
6,079,560 A * 6/2000 Champion ..... B65D 19/20 206/386
6,299,011 B1 * 10/2001 Rosenfeldt ..... B65D 19/0028 16/388
7,513,365 B2 * 4/2009 Cornelius ..... B65D 19/20 206/386
7,562,784 B2 * 7/2009 Stevenson ..... B65D 11/1893 220/4.26
7,717,265 B2 * 5/2010 Honkawa ..... B65D 19/44 206/730
11,542,061 B2 1/2023 Shuert et al.
(Continued)

*Primary Examiner* — Jacob K Ackun
(74) *Attorney, Agent, or Firm* — Young Basile Hanlon & MacFarlane, P.C.

(57) ABSTRACT

An increased volume palletized container comprising upper and lower foldable, four walled sleeves which are joined to one another in a substantially edge to edge stacked relationship using molded plastic clips some of which receive and can be locked to a notched adjacent mating edge of the stacked sleeves to join the sleeves together in a gapless fashion. At least some clips have an H configuration with a center rib that separates and prevents direct contact between the adjacent edges of the two sleeves.

3 Claims, 5 Drawing Sheets

(56) References Cited

U.S. PATENT DOCUMENTS

2007/0251857 A1* 11/2007 Watanabe ..... B65D 19/02
206/600

* cited by examiner

SYSTEM USING CLIPS FOR JOINING CONTAINER SLEEVES

INTRODUCTION

In our U.S. Pat. No. 11,542,061 issued Jan. 3, 2023 we show a shipping container for bulk goods comprising the combination of a four-walled accordion-foldable composite sleeve that can be joined to a molded plastic pallet wherein the sleeve is joined to the pallet by means molded plastic clips the edges of which fit into a groove in the pallet base and, where used, a molded plastic cover.

U.S. application Ser. No. 18/665,610 filed May 16, 2024 shows how such a sleeve may be joined to pallets which have no sleeve-edge-receiving groove by the use of an adapter which can also be used as a cover to provide the advantage of allowing two fully assembled containers to be stacked one atop the other.

In this document we show how sleeves usable in creating palletized containers can be joined edge to edge one on top of the other to increase the size and load capacity of the resulting container wherein clips of various designs are used on the sleeve edges to join the sleeves together and to join the lower sleeve to a pallet base. This sleeve stacking or joining technology may be used with grooved base pallets in accordance with our aforementioned patent as well as with ungrooved pallets requiring the use of the aforesaid adaptor as described in our above identified application.

BRIEF DESCRIPTION OF THE DRAWINGS

The various features, advantages and other uses of the present apparatus will become more apparent by referring to the following detailed description and drawing in which.

DETAILED DESCRIPTION OF THE REPRESENTATIVE EMBODIMENTS

Figure 1:
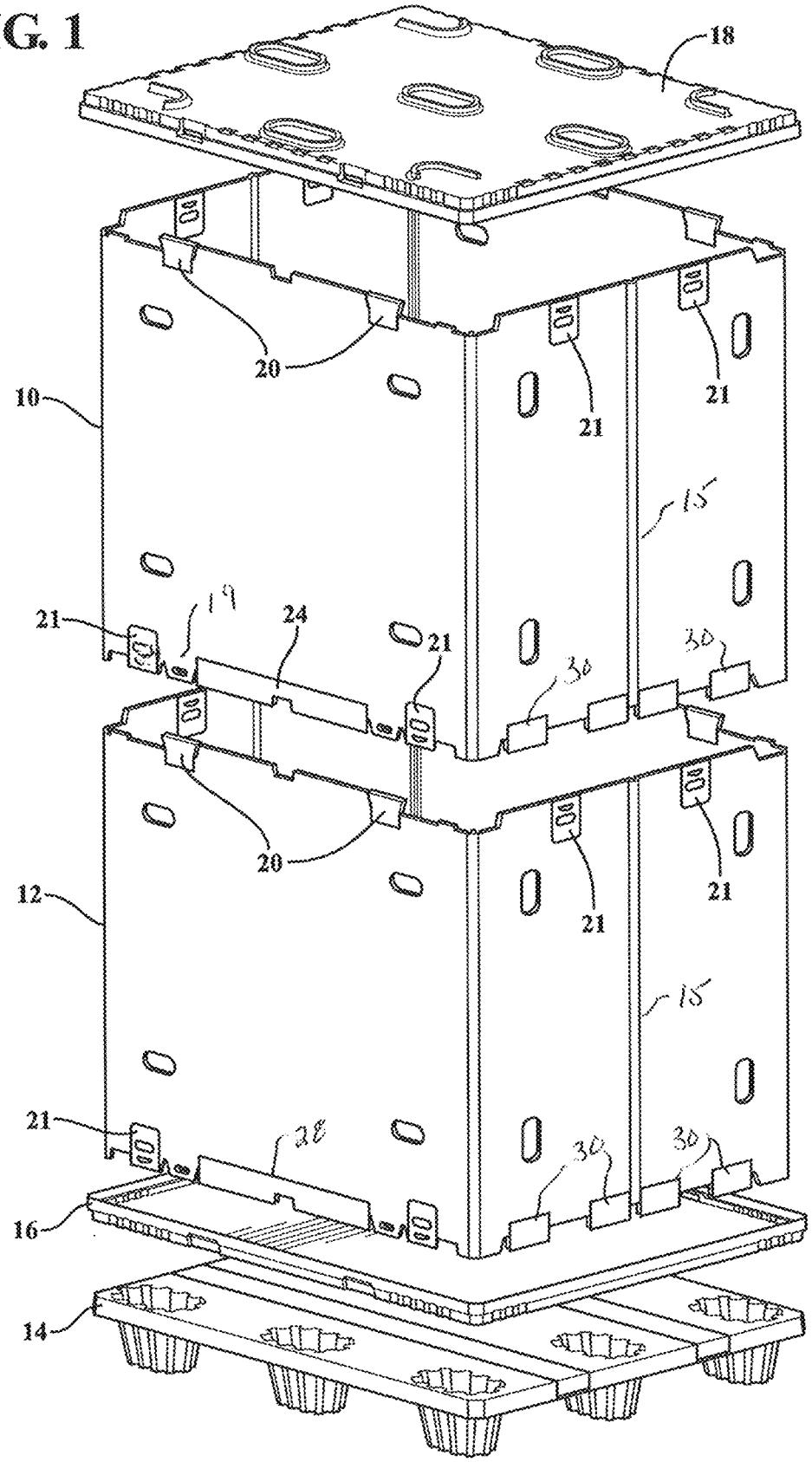
FIG. 1 is a perspective view of an increased volume container structure wherein two sleeves are designed to be joined together in stacked relationship and an adaptor is used to join the lower of the two sleeves to a pallet base.

Referring to FIG. 1 there is shown in exploded form the stacked/stackable combination of two identical accordion-foldable, composite four walled sleeves 10 and 12 wherein the lower sleeve is configured and equipped to be joined to a base pallet 14 of molded plastic construction as described in our aforesaid provisional application; i.e. the lower sleeve 12 is joinable to the molded plastic pallet 14 by way of an adaptor 16 which, when inverted, also serves as a cover 18 for the top most sleeve 10. Where the pallet base is grooved to receive the bottom edge of the lower sleeve, the adapter 16 is not needed but the cover 18 may still be required. Each sleeve 10, 12 has an internal fold hinge 15 in the center of a side panel as well as corner hinges so a sleeve may be folded flat accordion style for storage or return shipping.

Figure 2:
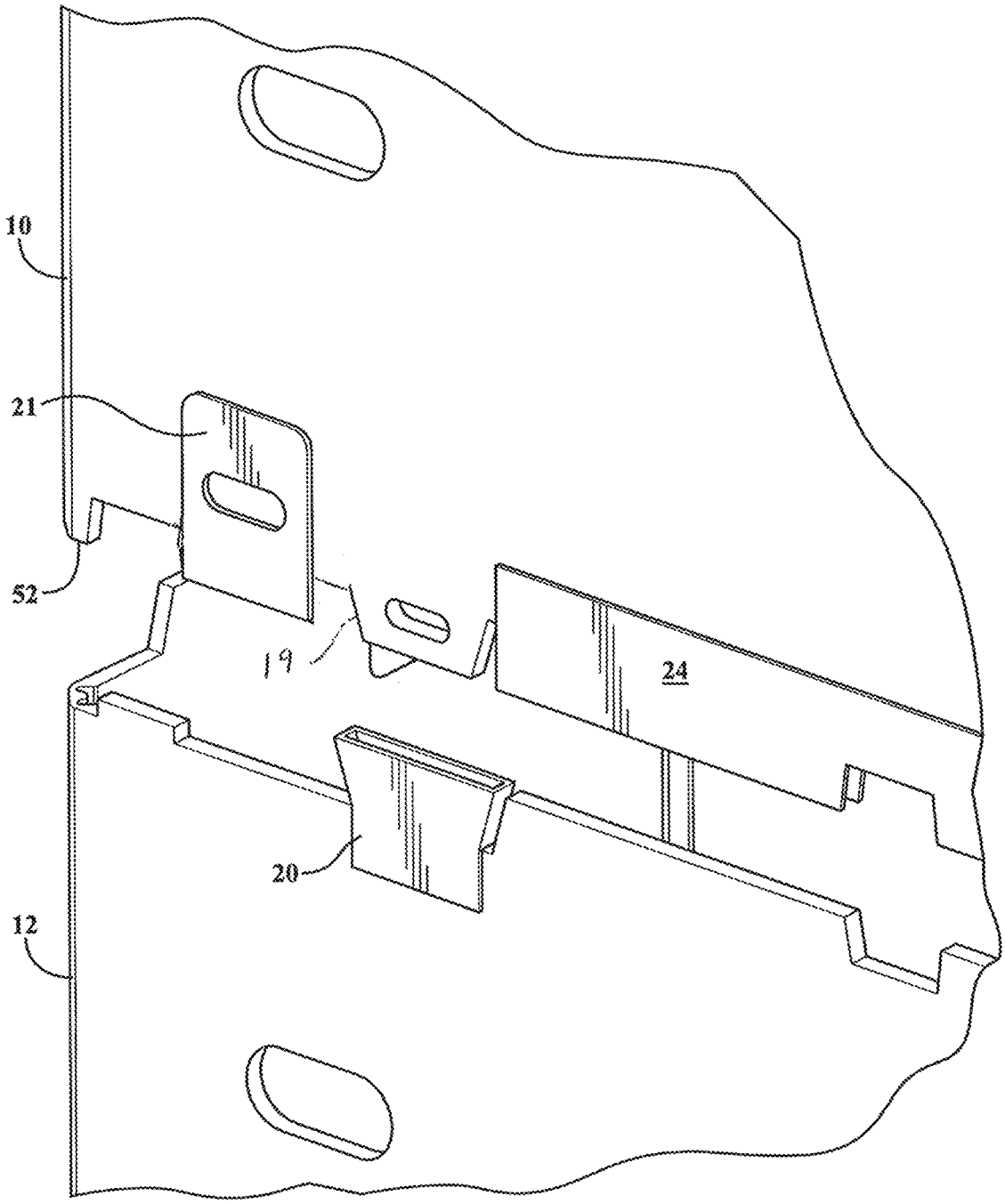
FIG. 2 is a close up of portions of the edges of the two sleeves of FIG. 1 showing the manner in which the sleeves are joined using clips of various designs.
Figure 3:
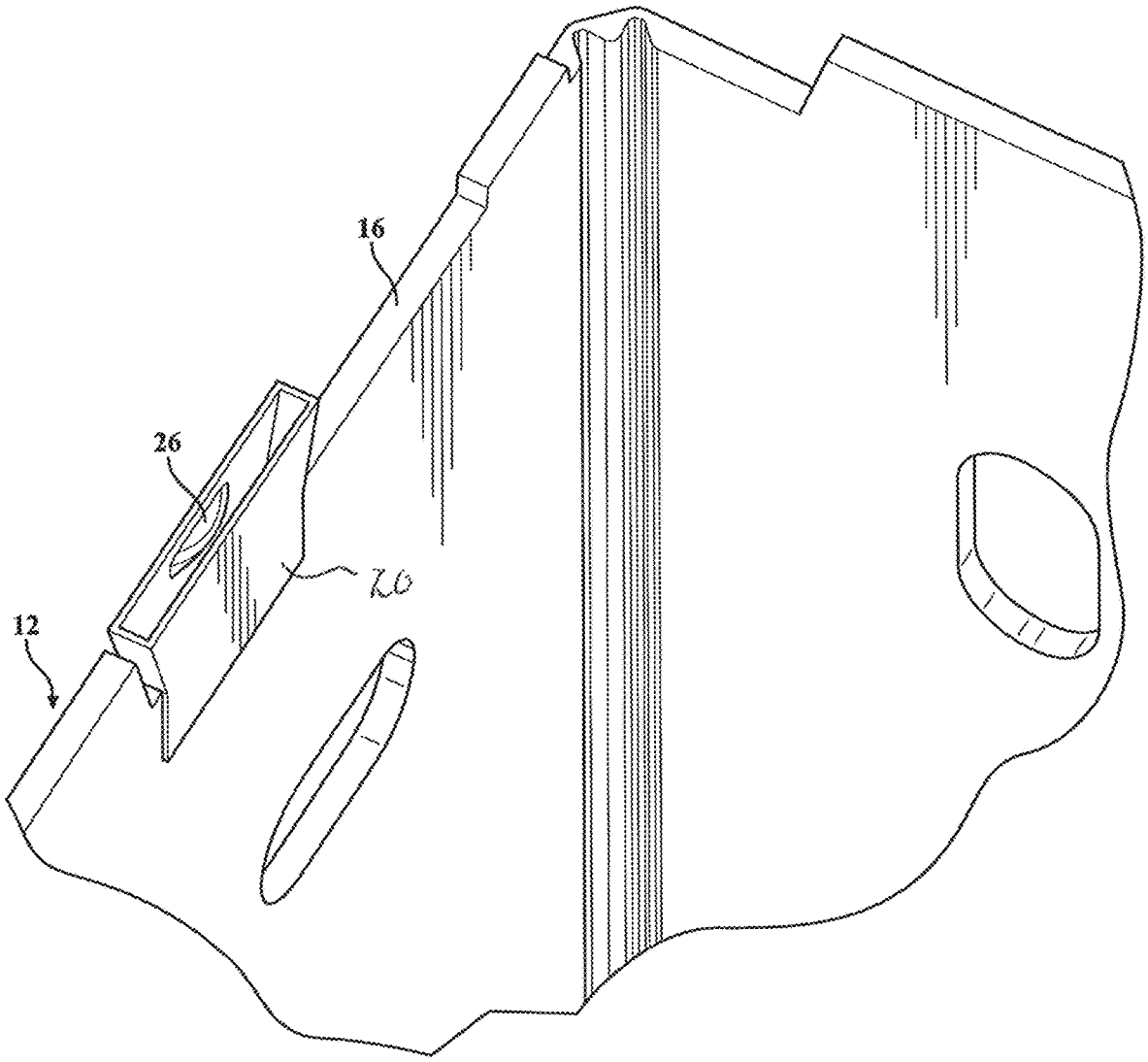
FIG. 3 is a perspective view looking down at one of the clips on the lower sleeve of the combination shown in FIG. 2.

As best illustrated in FIGS. 2, 3, 4 and 6-9, the upper and lower edges of each of the sleeves 10 and 12 are configured with a pattern of notches and tabs to receive clips 20, 21 and 24 having different functions. Clips 20 and 21 are designed to join the sleeves 10 and 12 together and to "lock" onto at least one of the sleeves by way of a tab and slot combination as hereinafter described. Clips 20 are attached to the lower sleeve 12 as shown in FIG. 2 and are configured with a flared top to receive the slotted tab 19 on the bottom edge of the upper sleeve 10 whereas clip 21 is joined to the bottom edge of the upper sleeve 10 by means of a tab/slot combination. The clip 20 is again shown in FIGS. 3 and 4 to have an H shaped cross section with upper and lower spaces to receive upper and lower sleeve edges portions as well as a central rib 23 that the sleeve edges contact when fully inserted into the clip. In that regard, the entire lengths of the mating sleeve edges do not come into direct contact with one another. Rather, a large portion of the edge length has clip material between the mating edges to prevent exteriorization of the sleeve edges by rubbing contact. Int the examples shown, only edge portions near the corners of the sleeves come into direct contact with one another. However, the use of notches in the sleeve walls at the clip mounting locations prevents the formation of gaps between the sleeve edges at the mid-point mating area. The clips 21 are joined to the upper sleeve 10 by way of a tab and slot combination 32 simply by placing the clip on the top edge of the lower sleeve 12. The top half of the H shaped combination receives and is joined to the bottom edge area of both sleeves 10 and 12 as well as the top edges of sleeve side panels. The bottom portion of the H design receives the edge portion of the lower sleeve 12 and/or the edge of adapter 16 as well as the edge configuration of the lower sleeve of the combination shown in FIG. 1. Clips 20 which are best shown in FIGS. 2 and 3 have double walled bottom openings and outwardly tapered, closed wall top portions forming a cup like receiver with an integrally formed, inwardly extending wedge-shaped locking tab 26 to receive therein a slotted tab 19 on the bottom edge of the top sleeve 10 in the combination. There are two sets of joining clips on each of the front and back edges of the container combination shown in FIGS. 1 and 2. A number of clips 20 and 21 are present on the front and rear panels and on both top and bottom edges of certain panels in the combination as best shown in FIGS. 1 and 2 to provide added stability in the joined sleeves. The term "tab" is used herein to refer to a wedge-shaped projection integrally formed on an inside wall of clip 20 to perform a joining function with a slot in a sleeve wall near an edge. While this is referred to as a "locking" function, it is to be understood that the "locked" elements can be taken apart without tools such as keys or pry bars. The center rib 23 of the clip shown in FIG. 4 lies between edges of the sleeves when in the joined combination such that the edges of the sleeves do not directly engage one another. This prevents forces and movements that can damage the sleeve edges.

Figure 4:
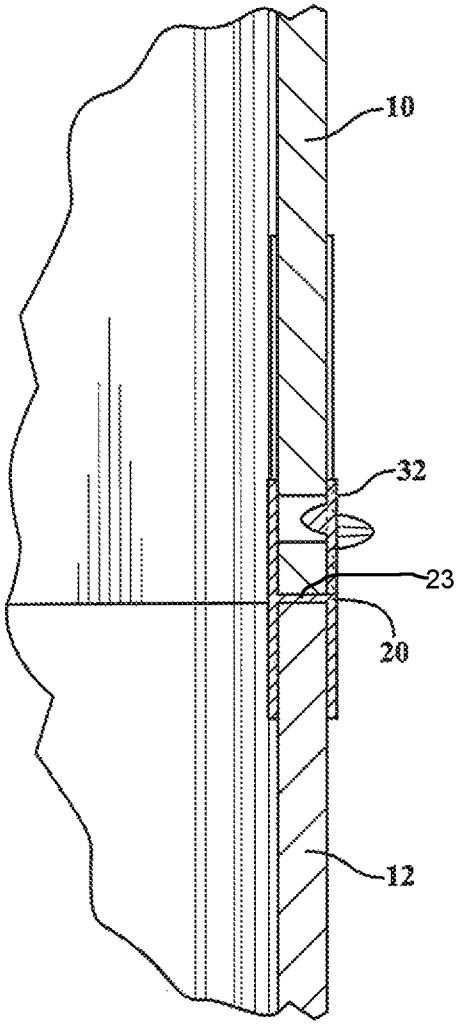
FIG. 4 is a cross-sectional view showing the joinder of upper and lower sleeves by means of one of the clips shown in the previous figures.
Figure 6:
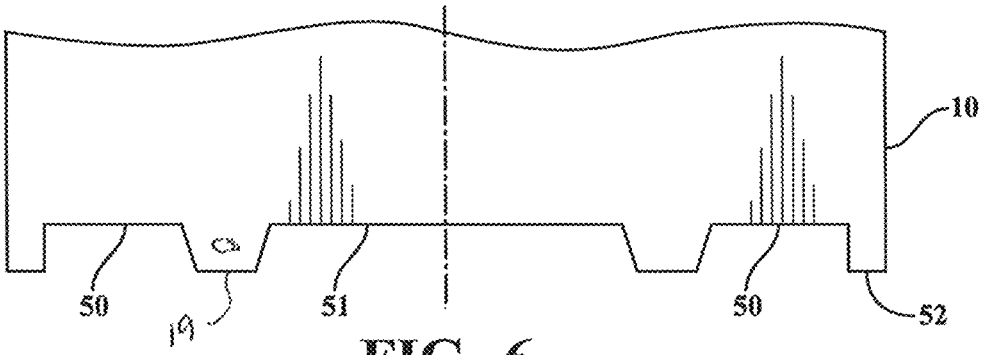
FIG. 6 is a view of the bottom edge of a sleeve front panel.

As shown in FIGS. 3 and 4 joining the sleeves causes the downwardly projecting bottom edge tabs 22 which are also tapered to fit into the cup-shaped upper portion of the clip 20 far enough to bring the sleeve edges together and at the same time to cause wedge-shaped tab in the clip 20 to fit into the slot in the downwardly projecting tab 19 on the bottom edge of the top sleeve 10. Four such joining arrangements are used on the front panel as shown in FIGS. 1 and 2 on the back panel in a configuration that is identical to that in front panel. The edges of a sleeve with no attached clips are shown in FIGS. 7 through 10.

Figure 5:
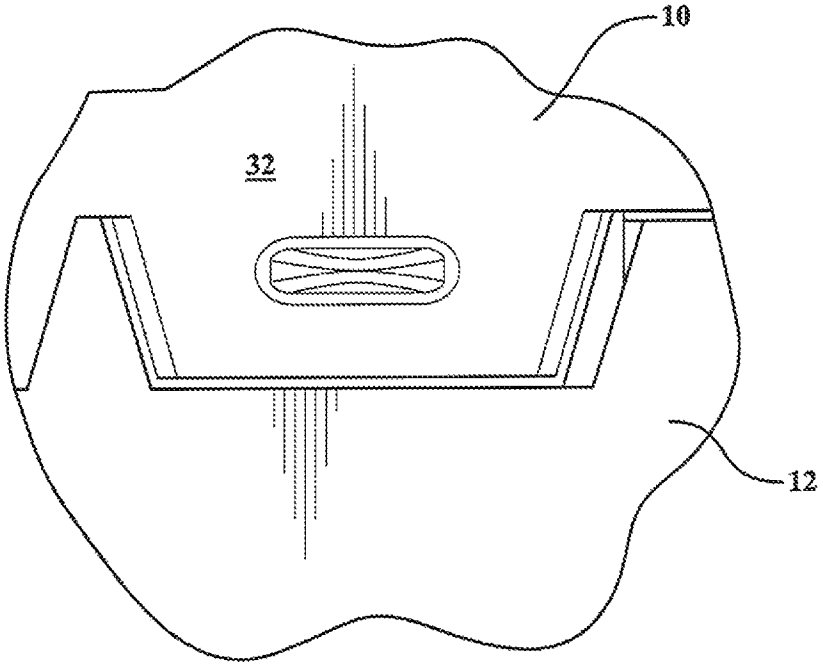
FIG. 5 is a partial view of a clip joining two sleeves.

A wide stabilizing clip 24 is placed centrally on each of the front and rear panels of the upper sleeve 10 and has a H-shaped configuration with a table bottom opening as shown in FIG. 5 to slide onto and receive the top edge of the lower sleeve 12 in the stacked combination.

Similar clips 28.30 and 32 may be placed along the side edges both right and left using the configuration shown in FIGS. 1 and 5 for semi-permanent attachment to the bottom edge of each sleeve. It will be understood with reference to FIG. 5 that the clips 20 simply slide onto the top edge of the lower sleeve 12 for stabilizing purposes but perform not locking function in that arrangement.

The clips 20 may or may not be lockingly joined to the lower sleeve 12 by means of tab/slot arrangement, the better practice being to use a locking function to prevent loss of the clips when the sleeves are taken apart for storage and/or returned to a place of assembly and filling of the resulting large capacity container.

It will be understood that for the foregoing that the sleeves may be used with and without adaptor 16 shown in FIG. 1 in which case it is understood that the pallet base is grooved as shown in the aforementioned patent to lockingly received the bottom edge of the lower sleeve. The sleeves 10 and 12 are shown with corner hinges as well as inwardly fording accordion hinges in the side wall panels. In Addition, the front panels can have optional bottom-hinged access doors.

The disclosed combination results in a large capacity container having a pallet base and comprises lower and upper foldable, four walled sleeves each having top and bottom edges and multiple sets of molded plastic clips located between a top edge of one sleeve and a bottom edge of the other sleeve wherein some of said clips have an H configuration, an upper portion of which receives therein an edge portion of one sleeve, a lower portion that receives an edge portion of the other sleeve and a center rib formed integrally between the outer parallel walls of the H confirmation lies between the two edge portions of the sleeves. Some of the clips can have a locking tab formed integrally and internally of one of the wall portions extending toward but not fully meeting the other wall portion so that when a container sleeve wall is placed into the area between the parallel walls of the clip a slotted area of the sleeve receives the wedge-shaped tab of the clip thereby locking the clip to the sleeve to prevent loss. Some clips may have the structure shown and described in our patent Ser. No. 11,542,061 issued Jan. 3, 2023.

Figure 7:
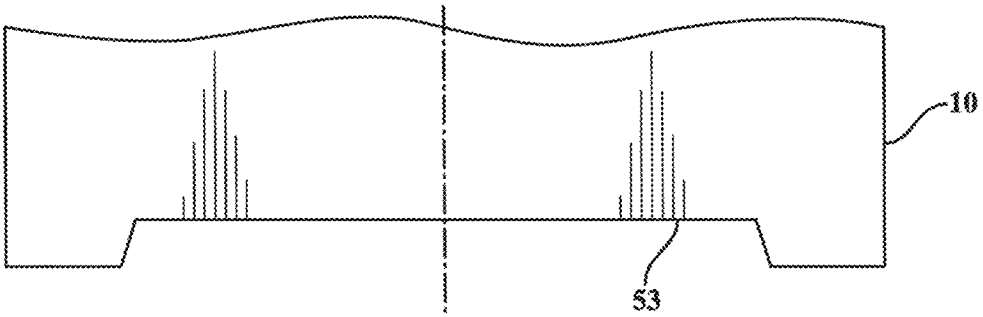
FIG. 7 is a view of a bottom edge of a sleeve side panel.
Figure 8:
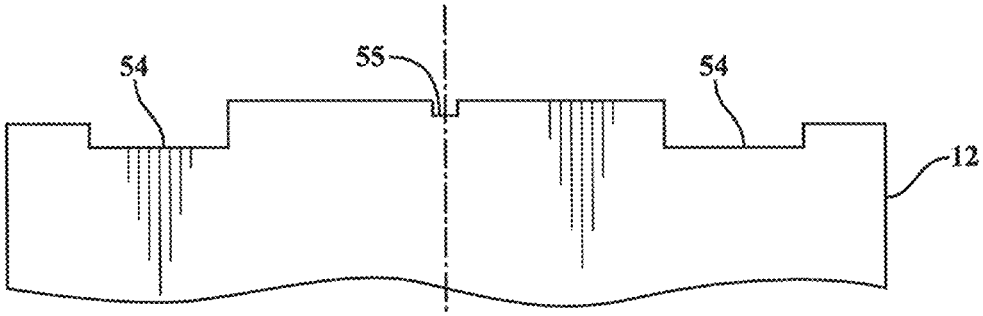
FIG. 8 is a view of a top edge of a sleeve front panel.
Figure 9:
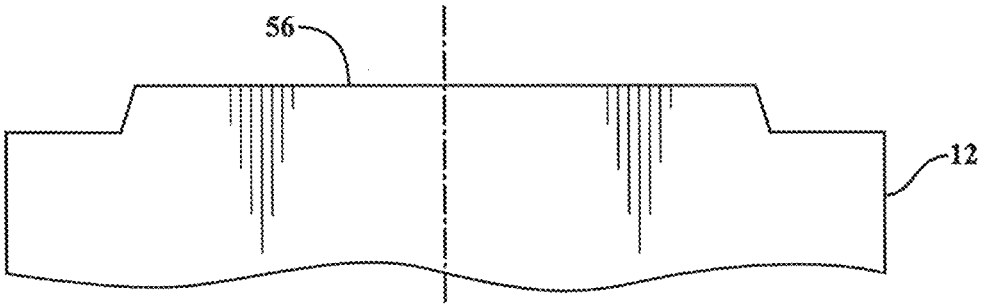
FIG. 9 is a view of a top edge of a sleeve side panel.

Referring to FIGS. 6-9, the bottom edge of the front panel of sleeve 10 is shown to have notches 50 on both sides of a vertical centerline to receive clips 21 and a wide center notch 51 to receive wide clip 24. Only the corners 52 contact the edge of a lower sleeve in the assembled combination. FIG. 7 shows a side sleeve panel to have a single wide notch 53 to receive multiple clips 13 as shown in FIG. 1. FIG. 8 shows the top front edge of sleeve 12 to have notches 54 for clips 20 and a center notch 55 to open the access door. FIG. 9 shows the top edge 56 of the side panel in sleeve 12

In summary, the innovation is a novel method and apparatus for increasing the capacity of a sleeve-type palletized container by joining container sleeves essentially edge to edge in a stable and stacked arrangement by use of special purpose molded plastic clips. It is to be understood that the term "edge to edge" does not mean that the entire edges are in direct mating contact but rather that the edges are brought into close relationship but may in some or even most areas be separated by an internal clip rib. Most clip locations can be notched such that the nearby adjacent sleeve edges are brought into contact.

In addition, it will be understood that the sleeves themselves can have different constructions depending on the types of cargo to be carried. For the most part sleeves of composite or multiple layer construction are used where the construction includes outer sheets of polymeric or coated paper material separated by a corrugation layer also of polymeric or paper construction. Such sleeves are waterproof, relatively light weight and durable. To the extent the multi-sleeved container is loaded in transit, the load is born primarily by the pallet base and the clips reduce the forces on the walls of the lower sleeve. The clips 21 used in the combination described herein may also be of the design shown and described in U.S. Pat. No. 11,542,061, the disclosure of which is incorporated therein by reference.

What is claimed is:

1. A large capacity container for use with a pallet base comprising first and second foldable four walled sleeves each having top and bottom edges, and a plurality of molded plastic clips joining a top edge of a lowermost of the sleeves to the bottom edge an uppermost sleeve;

wherein said clips have an H configuration with upper and lower volumes defined by two parallels outer walls and an integral center rib wherein the upper volume of the H configuration receives an edge portion of one sleeve and the lower volume of the H configuration receives an adjacent edge portion of the other sleeve, and said center rib lies contactingly between the two edge portions.

2. The container described in claim 1 wherein said some of the clips have an interior tab formed integrally with one of the wall portions and extending partially toward the other parallel wall portion and a sleeve wall has a slot formed therein in an area designed to receive a clip such that a tab in the clip wall fits into the slot in the sleeve wall.

3. A container as described in claim 1 wherein said clips join the side panels of container sleeves together essentially edge to edge and comprise a body having integral upper and lower walled and open-ended volumes separated by and interior rib wherein the upper volume is tapered from an open top of larger dimension to the interior rib to assume a cup shape whereas the lower volume is of constant cross-sectional size and shape.

* * * * *